United States Patent [19]

Bochan

[11] 4,332,152

[45] Jun. 1, 1982

[54] WASHING MACHINE

[75] Inventor: John Bochan, Louisville, Ky.

[73] Assignee: General Electric Company, Louisville, Ky.

[21] Appl. No.: 196,803

[22] Filed: Oct. 14, 1980

[51] Int. Cl.[3] ..... D06F 21/06

[52] U.S. Cl. ..... 68/171

[58] Field of Search ..... 68/23 R, 38, 148, 152, 68/153, 154, 171, 172, 173, 174

[56] References Cited

U.S. PATENT DOCUMENTS

| | | | |
|---|---|---|---|
| 1,665,959 | 4/1928 | Graham et al. | 68/174 X |
| 3,603,118 | 9/1971 | Brucken | 68/174 X |
| 4,254,642 | 3/1981 | Stokes | 68/172 |

FOREIGN PATENT DOCUMENTS

| | | | |
|---|---|---|---|
| 1258187 | 2/1961 | France | 68/154 |

*Primary Examiner*—Philip R. Coe

*Attorney, Agent, or Firm*—Radford M. Reams

[57] ABSTRACT

A washing machine includes a fabric receptacle or basket formed with a vertical side wall having a plurality of spaced vertical inwardly extending ribs arranged thereon for engaging the fabrics upon inward movement of the ribs during the orbiting cycle to impart an annular, generally horizontal motion to the fabrics in the basket. A plurality of annular ledges are formed on a downwardly and outwardly sloping portion of the bottom of the basket. Each of the annular ledges includes an outwardly facing vertical section for engaging the fabrics in the basket when the orbiting motion of the basket causes the vertical sections to move outwardly. The basket further includes a plurality of spaced ramps formed adjacent the side wall of the basket at the bottom portion thereof and inclined upwardly in a direction opposite to the orbiting direction of the basket. A vertical wall is provided adjacent the inner edge of each of the ramps and this wall extends above the surface of the ramp. This wall causes increased movement of the fabrics engaging this wall, enhancing turnover of the fabric load and redistribution of fabrics within the load. Each of the ramps is formed to include an inclined section between the top of the wall and the ramp surface to minimize wedging of fabrics between the ramp wall and the side wall of the basket.

9 Claims, 5 Drawing Figures

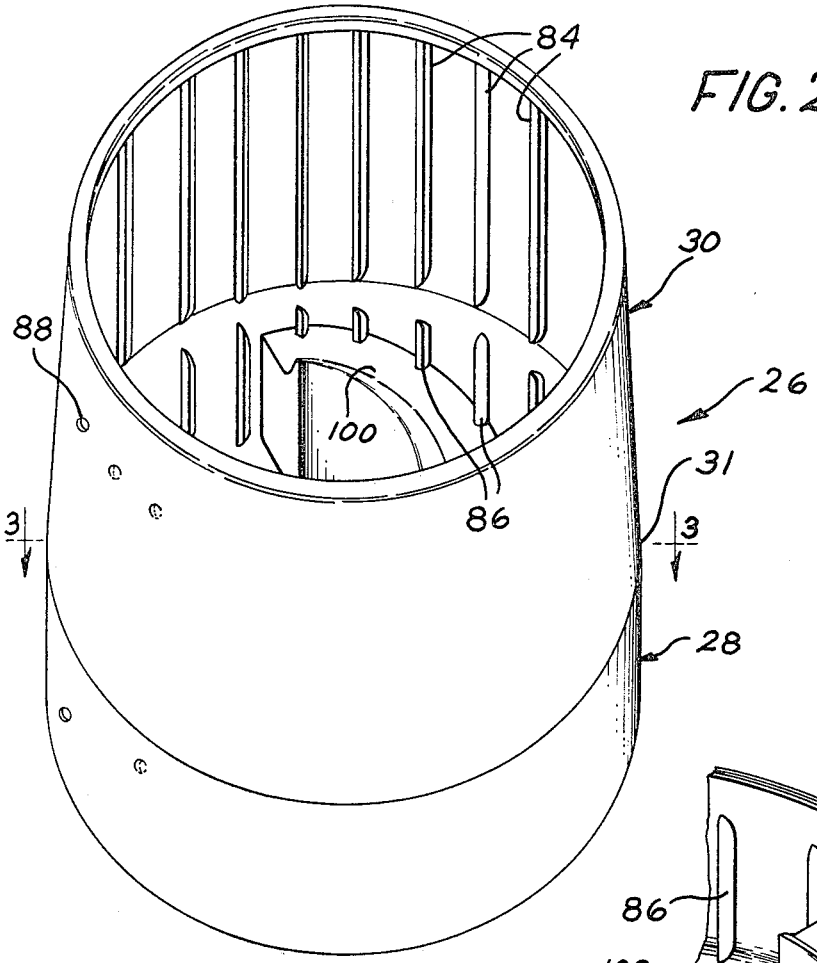
FIG. 2
FIG. 5
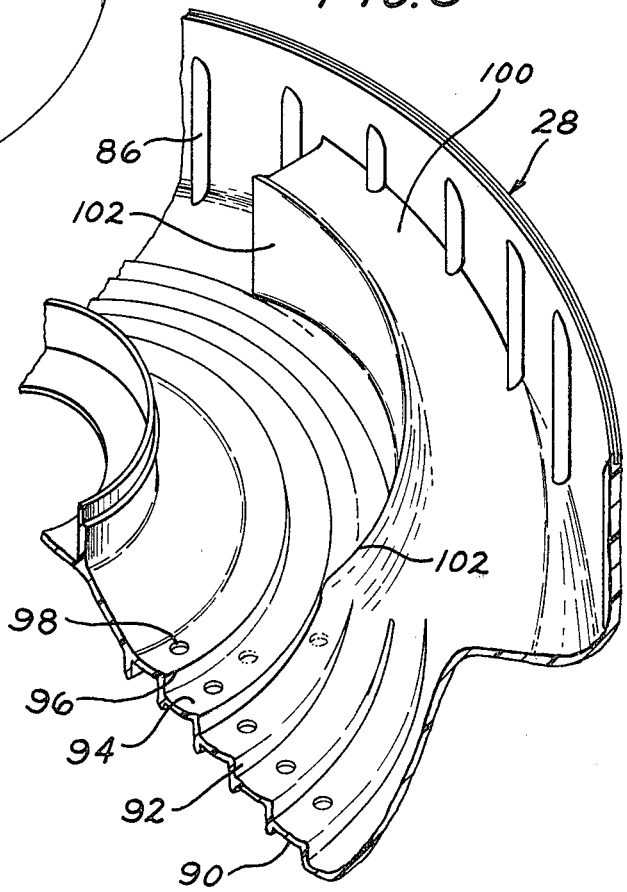

WASHING MACHINE

BACKGROUND OF THE INVENTION

1. Field of the Invention

This invention relates to washing machines for washing fabrics, such as clothes, and more particularly to such machines having an orbital motion of the fabric receptacle during the agitation mode, that is during the washing and rinsing portions of the cycle of the washing machine.

2. Description of the Prior Art

Conventional clothes washing machines of the vertical-axis agitator type are usually rather large and complex. In such machines, there is generally provided a cabinet inclosing a water-retaining tub in which is disposed an inner fabric-receiving receptacle or basket. An agitator is mounted within the basket. The agitator and basket are coupled to a suitable power transmission driven by an electric motor. The transmission converts the high speed of the motor to a speed appropriate for centrifugal extraction of water from the fabrics in the basket and to a slower oscillatory motion of the agitator during the washing and rinsing portions of the operating cycle of the washing machine. Such machines usually include a water pump for recirculating water within the machine and a filter for separating out lint or other particles from the recirculated water. Inherently, such machines use large amounts of water. Also there is a high energy interface between the fabrics being washed and the oscillating agitator. Many such machines have vibration and traveling problems resulting from imbalances in the machines during the centrifugal water extraction or spinning operation. Such machines have frequently required complex suspension systems, including counterweights, and often the basket is provided with an annular balance ring in a further effort to alleviate the vibration and traveling problems.

Various alternatives have been proposed to simplify such washing machines and to eliminate or reduce some of the problems referred to above. One such alternative arrangement is that illustrated and described in my application, Ser. No. 39,406, filed May 15, 1979 and in my copending continuation-in-part application, Ser. No. 142,949, filed Apr. 23, 1980, both assigned to the assignee of the present invention. The washing machine illustrated and described in my aforementioned applications is of the vertical-axis type wherein the fabric receptacle or basket is driven during the agitation mode, that is during the washing and rinsing portions of the cycle of operation, in such manner that the basket moves in an orbital path. The basket is restrained from rotating about its axis while being orbited. After the washing or rinsing action has been completed, provision is made for substantially aligning the basket axis with the axis about which it was orbiting, and the basket is then rotated about this latter axis to centrifugally extract water from the fabric load. In the structure of my aforementioned applications the basket is provided with a plurality of inwardly extending vertical ribs and with a plurality of inclined vanes for effecting movement of the fabric load during the washing and rinsing operations to more effectively remove soil from the fabrics, for example clothes, comprising the fabric load.

An improvement in one aspect of the aforementioned applications is illustrated and described in the copending application of Everett Morey et al., Ser. No. 172,092, filed July 25, 1980, and assigned to the assignee of the present application. The basket structure of the Morey et al. application includes a plurality of annular ledges formed on a downwardly and outwardly sloping portion of the bottom of the basket. These ledges act in cooperation with ribs formed on the side wall of the basket and on inclined ramps provided adjacent to the side wall of the basket to effect an improved washing operation.

The present invention constitutes another improvement in such basket constructions, the improvement being directed toward achieving still more effective movement of the fabrics comprising the fabric load to secure more effective washing of these fabrics.

Accordingly, it is an object of this invention to provide a washing machine including an improved arrangement for effecting movement of the fabrics in the receptacle or basket during the washing and rinsing operations to provide for more effective removal soil from the fabrics.

It is a further object of this invention to provide a washing machine which includes an improved arrangement for increasing movement of the fabrics comprising the fabric load to enhance turnover of the load and redistribution of fabrics within the load.

SUMMARY OF THE INVENTION

In carrying out the invention, in one form thereof, a fabric receptacle or basket is formed to include a vertical side wall having a plurality of spaced vertical inwardly extending ribs arranged thereon for engaging the fabrics upon inward movement of the ribs during the orbiting cycle to impart an annular, generally horizontal motion to the fabrics in the basket. A plurality of annular ledges are formed on a downwardly and outwardly sloping portion of the bottom of the basket. Each of the annular ledges includes an outwardly facing vertical section for engaging the fabrics in the basket when the orbiting motion of the basket causes the vertical sections to move outwardly. These vertical sections act in conjunction with the ribs on the side walls of the basket to effect an annular movement of the fabrics in generally horizontal regions in a direction opposite to the orbiting movement of the basket and to effect straightening of the fabrics to remove soil, including particulate matter, from the fabrics and prevent such soil from collecting in the folds of the fabrics.

The basket further includes a plurality of spaced ramps formed adjacent the side wall of the basket at the bottom portion thereof and inclined upwardly in a direction opposite to the orbiting direction of the basket, in other words in the direction the fabrics are caused to move. The ramps cause the fabrics to turn over in a toroidal manner in vertical regions extending generally parallel to the side wall of the basket. The sloping arrangement of the annular ledges, as disclosed in the aforementioned Morey et al. application also causes a toroidal movement of the fabrics, this movement being in vertical regions. In accordance with the present invention a vertical wall is provided adjacent the inner edge of each of the ramps and this wall extends above the surface of the ramp. Each of the ramps is wider at its lower end than at its upper end and this lower end extends over at least some of the aforementioned annular ledges. The upper end of each ramp and the vertical wall associated therewith are disposed radially outward of the outermost of the annular ledges. Each of the ramps is formed to include an inclined section between the top of the wall and the ramp surface to minimize wedging of fabrics between the wall of the ramp and the side wall of the basket.

BRIEF DESCRIPTION OF THE DRAWINGS

In the accompanying drawings:

FIG. 2 is a perspective view of the basket or fabric-receiving receptacle of the washing machine of FIG. 1;

FIG. 5 is a sectional elevation view taken along the line 5—5 in FIG. 3.

DETAILED DESCRIPTION OF THE PREFERRED EMBODIMENT

Figure 1:
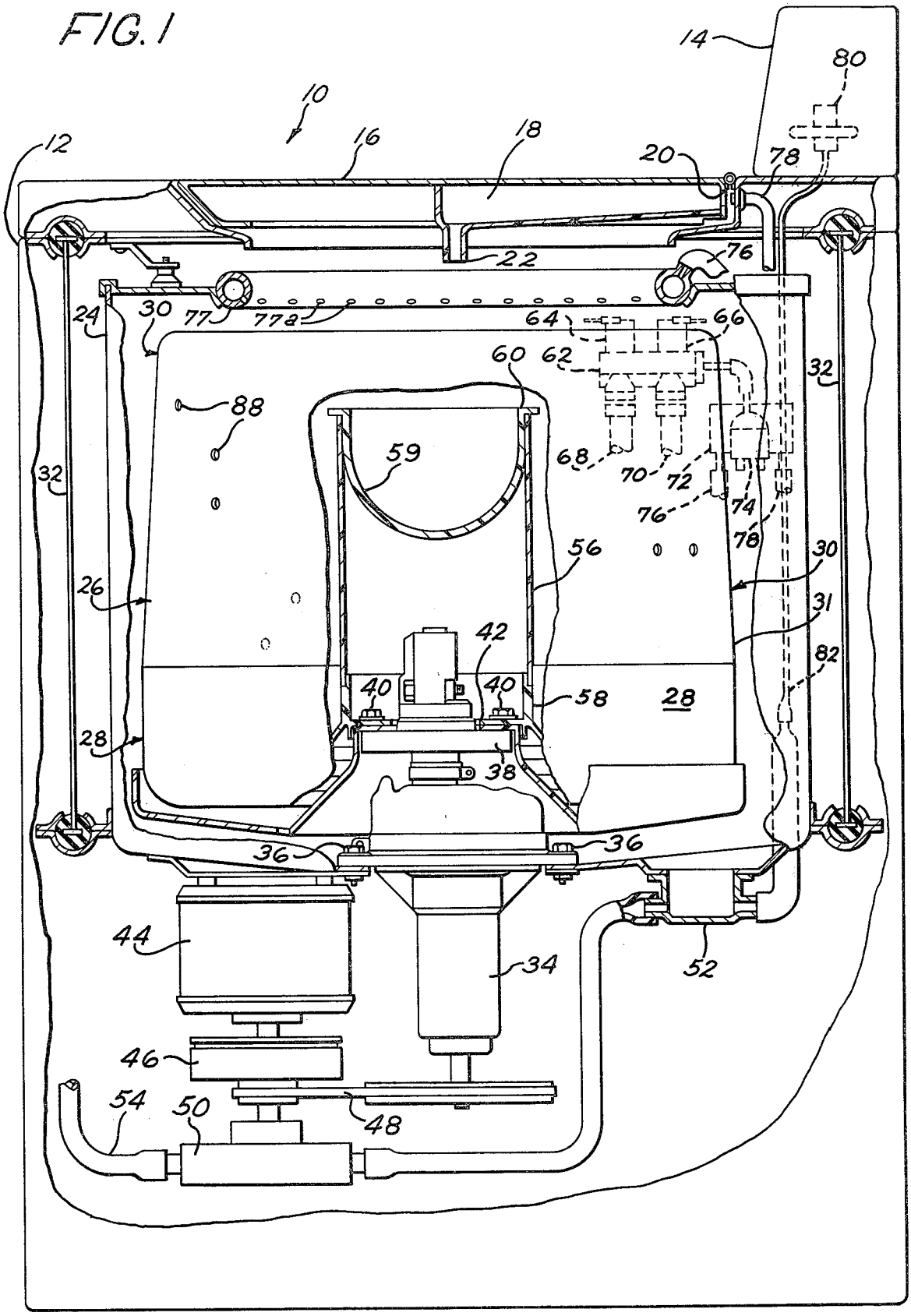
FIG. 1 is an elevation view, partly in section, of a washing machine incorporating an embodiment of this invention.

Referring to the drawings there is shown in FIG. 1 a washing machine 10 of the vertical-axis type which includes a cabinet 12. The cabinet includes a control panel 14 which is normally provided with a plurality of switches and controls employed by the user in the operation of the machine. In the top of the cabinet there is provided an access lid 16 hinged for movement between the closed position as shown and an open position permitting access to the interior of the washing machine. Lid 16 is provided with a water-receiving trough or compartment 18 having a fluid inlet aperture 20 and a discharge spout 22.

Within the cabinet is disposed an imperforate stationary tub or casing 24. Within this tub there is disposed a basket or receptacle 26 for receiving fabric articles, such as clothing, to be washed. The basket 26 is intended to be of relatively light weight and may be molded, for example, from a plastic material such as polypropylene. In the particular form shown the basket is of two-piece construction and includes a bottom 28 and a body 30. The bottom 28 and the body 30 are formed with interengaging shoulders and may be joined into a unitary basket by means of any liquid bonding agent suitable for use with the plastic and applied at the interengaging shoulders. A side wall 31 of the basket is formed, in part, by the bottom 28 and, in part, by the body 30.

The tub 24 is suspendedly mounted on the cabinet 12 by three rods, two of which are indicated at 32 in FIG. 1. A transmission 34 is mounted in opening in the tub 24 and secured to the tub by means of a plurality of bolts 36. The transmission includes a collar 38 and the basket 26 is mounted on this collar in driving relationship with the transmission by bolts 40 extending through a central flange 42 of the basket and received in the collar 38. The basket 26 is driven through the transmission 34 by means of a reversible electric motor 44 connected to the transmission through a suitable load-limiting clutch 46 and a belt 48.

The transmission is illustrated only generally because the details of the transmission are not part of the present invention. It may be of the general type illustrated and described in my aforementioned application Ser. No. 142,949. In the transmission there disclosed when the motor 44 is rotated in one direction the transmission causes the central axis of the basket 26 to orbit about the axis of the shaft of the transmission in a substantially horizontal plane, the basket itself being prevented from rotating about its own axis. Conversely, when the motor 44 is rotated in the opposite direction the transmission substantially aligns the axis of the basket 26 with the axis of the input shaft of the transmission so that the basket rotates about its own axis at a high speed for centrifugal extraction of liquid from the fabrics in the basket. More particularly, the transmission conveniently may be of the type referred to as "Alternate Transmission" in my aforementioned application Ser. No. 142,949. It has been found that very effective turnover of the fabrics is achieved when the upper shaft of the crankshaft of the "Alternate Transmission" is canted approximately one degree, as illustrated and described in the copending application of Gerald L. Roberts, Ser. No. 203,208, filed Nov. 3, 1980, and assigned to the assignee of the present application.

The electric motor 44 is also arranged to drive a pump 50 for withdrawing liquid from a sump 52 and discharging it through a hose 54 to a suitable drain (not shown). The particular form of the pump 50 is not important so long as the pump withdraws liquid from the tub in response to the rotation of the motor 44 in either direction.

The basket 26 includes a centerpost 56 which is attached to a shoulder 58 extending upwardly from the bottom of the basket at the central portion thereof. The centerpost 56 has cup-shaped receptacle 59 press fitted therein, an annular rim 60 of the receptacle 59 engaging the upwardly extending cylindrical wall of the post 56. The receptacle 59 is adapted to receive and dispense detergent and/or other wash additives during portions of the wash cycle when water is supplied to the receptacle 59 from the spout 22.

The washing machine 10 shown in FIG. 1 is a fresh-water, flow-through machine. It includes water supply means in the form of a solenoid-operated mixer valve 62 having solenoids 64 and 66 and coupled to sources of hot and cold water, such as household faucets, through hoses 68 and 70 respectively. The output of the mixer valve 62 is fed through a solenoid diverter assembly 72 having a solenoid-operated control valve 74. When the valve 74 is in one position all the water entering the diverter assembly 72 is directed through hose 76 to a fill ring 77, from which the water is discharged through apertures 77*a* onto fabrics in the basket 26. When the valve 74 is in a second position water is divided between hoses 76 and 78, the water through hose 78 being directed through the lid 16 and spout 22 to the receptacle 59.

A water level switch 80, which may be of any type well known in the art, is mounted in control panel 14. The switch 80 is connected through an air chamber 82 to the sump 52. As water accumulates in the sump, the air in the chamber 82 is compressed to close the switch 80.

Particular details of the water supply and discharge are not critical to the present invention. The elements and their operation are described more fully in my aforementioned applications. The present invention is directed to the structure of the fabric-receiving receptacle or basket shown in more detail in FIGS. 2–5 and more particularly to certain aspects of the ramp structure shown therein. Referring to FIG. 2, the portion of side wall 31 formed by the body 30 includes a plurality of vertical inwardly extending ribs 84, and the portion of side wall 31 formed by the bottom 28 includes a plurality of inwardly extending vertical ribs 86. The vertical ribs 84 and 86 on the side wall 31 of the basket are not in themselves part of the present invention, and their structure and operation in effecting of washing action are illustrated and described in my aforementioned applications. The side wall of the basket includes a plurality of apertures 88, some of which are shown in FIGS. 1 and 2, for centrifugal extraction of water therethrough during that portion of the cycle of the washing machine.

Figure 4:
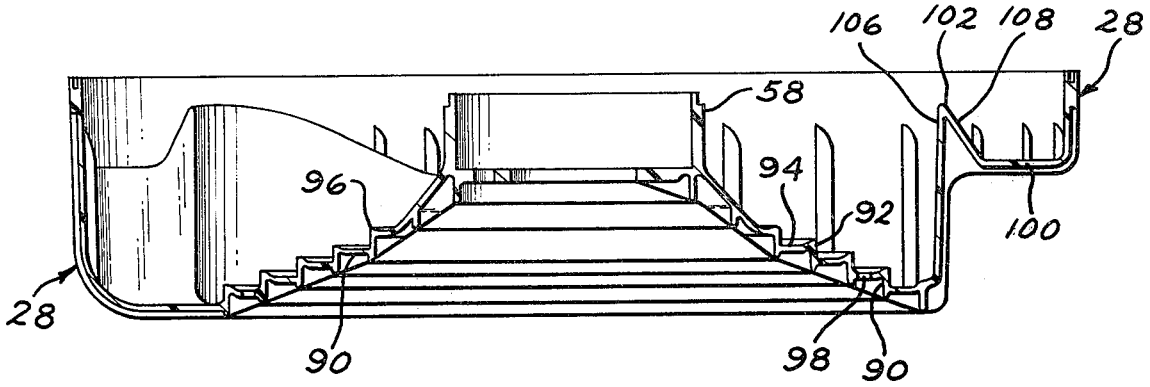
FIG. 4 is a sectional elevational view taken along the line 4—4 in FIG. 3.
Figure 3:
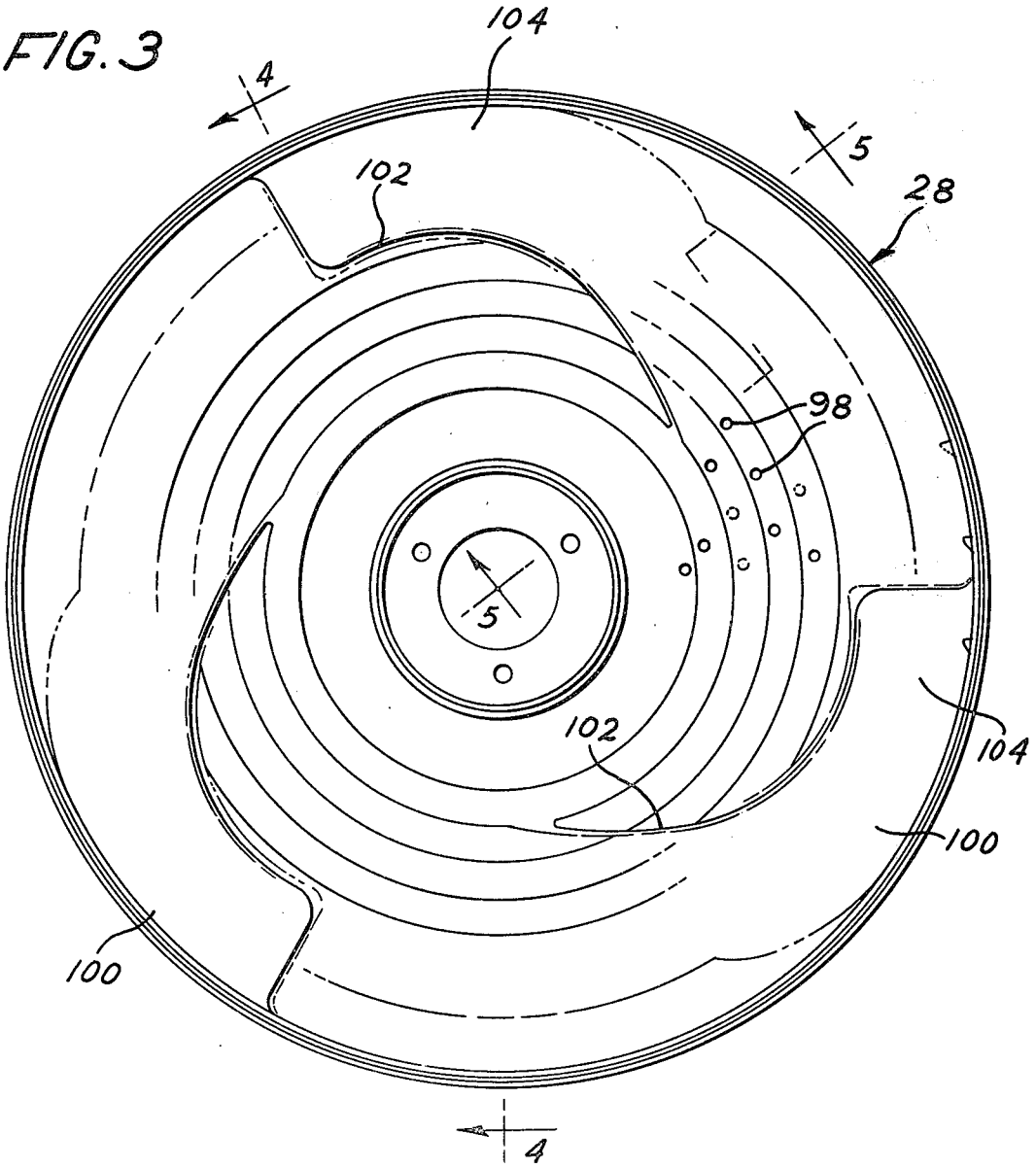
FIG. 3 is a sectional plan view taken along the line 3—3 in FIG. 2.

Referring particularly to FIGS. 3, 4 and 5 the bottom 28 of the basket 26 is formed to include a plurality of annular ledges 90 formed on a downwardly and outwardly sloping portion of the bottom of the basket. Each of the annular ledges is formed to include a vertical section 92 and a somewhat concave generally horizontal section 94. Each concavity is formed by a raised lip 96 provided at the outer edge of the horizontal section and includes a plurality of apertures 98 through which water and soil particles are discharged to the bottom of tub 24 and to the sump 52. The vertical sections 92 impact the fabrics in the basket when the sections are moving outwardly during the orbiting of the basket and thereby tend to cause an annular rotation of the fabrics in the direction of the orbiting motion of the basket. Further the arrangement of these ledges to form a generally downwardly and outwardly sloping surface causes an outward movement of the fabrics at the bottom of the basket to bring these fabrics into contact with side wall 31, inclined ribs 84 and 86. This circulation of the fabrics along the bottom surface of the basket aids in the overall turnover of fabrics in the load. The provision of the annular ledges and their operation in the manner just described is not part of the present invention but is illustrated and described in the aforementioned copending application of Everett D. Morey et al.

Each portion of side wall 31, including corresponding ribs 84 and 86, engages the fabrics as that portion of the side wall moves inwardly during the orbital movement of the basket 26. This successive engagement of the side wall with the fabrics tends to cause the fabrics to "turn around" or move annularly within basket in a direction opposite to the direction of orbit of the basket. This is opposite to the annular motion tending to be imparted by the vertical sections 92. Since the net effect of side wall 31 is greater than the net effect of vertical sections 92, the fabrics move annularly around the basket in the direction opposite to the direction of basket orbit. Additionally the opposing forces provided by the side wall 31 and vertical sections 92 provide a straightening effect on the fabrics, which aids in effective separation of particulate matter from the fabrics.

In accordance with the present invention a plurality of inclined ramps 100 are provided adjacent the side wall of the basket at the bottom of the basket. These ramps are approximately equally spaced around the circumference of the basket. In the particular form shown three such ramps are employed but it will be apparent that a greater or smaller number could be employed, if desired. The ramps 100 are inclined upwardly in a counterclockwise direction, as viewed in FIGS. 2, 3, and 5. In the particular form of the invention shown the basket orbits in a clockwise direction and the fabrics in the basket move in a counterclockwise direction in generally horizontal regions; thus the ramps are inclined upwardly in the direction of movement of the fabrics in the basket. The radially outer fabric portions are engaged by the ramps. They travel up along the ramps and then fall back onto the mass of fabrics. The fabric portions radially just inside a ramp travel annularly around the basket in a generally horizontal path and tend to flow radially outward at the upper end of the ramp to fill the void created by the fabric portions moving up the ramp. Since the path up the ramp is longer than the adjacent generally horizontal path, the fabric portions traveling up a ramp are removed from the mass of fabrics and then redeposited on the mass of fabrics at a position slightly removed circumferentially from their prior position. This enhances the turnover or torodial movement of the fabrics. It also enhances redistribution of fabrics within the body of fabrics for effective, uniform washing action. The broad aspect of the ramps in effecting this turnover and redistribution of fabrics is illustrated and described in my aforementioned applications. The present application is directed to a particular ramp structure which provides enhanced turnover and redistribution for improved washing action.

Referring to FIGS. 2–5, each ramp 100 is formed to include at its inner portion a wall 102 which extends upwardly a significant distance above the surface 104 of the ramp. In the particular form shown, as best illustrated in FIG. 4, the upwardly-extending wall 102 is in the form of an inverted V in cross section and includes a vertical section 106 extending above the surface of the ramp and an outwardly inclined section 108 which joins the top of the vertical section 106 to the surface 104 of the ramp. The wall 102 extends downwardly to the bottom of the receptacle.

At the upper end of each ramp the wall 102 is disposed radially outwardly of the radially outermost one of the annular ledges 90. The ramp progressively widens toward its mouth at the lower end thereof so that at this point, as best shown in FIG. 5, the wall 102 overlaps three of the annular ledges and ends adjacent the second annular ledge from the center of the basket. This provides a wide mouth for causing a substantial portion of the fabrics in the basket to ride up each of the ramps so that the aforementioned toroidal turnover of the fabrics in generally vertical regions generally parallel to the side wall is accomplished. Each ramp becomes more narrow as it approaches its upper end but this end is still sufficiently wide so that the fabrics are not caused to wedge between the wall 102 and the side wall of the basket. The sloping section 108 further minimizes any tendency of the fabrics at the upper end of the ramp to become wedged between the wall 102 and the side wall of the basket.

In the preferred form of the invention the height of the wall 102 above the surface 104 of the ramp is progressively reduced from the upper portion to the lower portion of the ramp, being greatest near the top of the ramp and being smallest at the bottom of the ramp.

If desired, the section 108 could be omitted and a simple vertical wall, such as that portion of wall 102 shown at 106, could be provided extending above the surface 104 of the ramp. In that case the surface 104 would be extended radially inwardly to join the vertical section 106 below the top edge thereof. However, in the preferred form of this invention the inclined section 108 is employed because of its effect in minimizing any tendency of fabrics to become wedged between the side wall of the basket and the upwardly extending wall 102.

The walls 102 serve a number of functions. First, they act to stop fabrics from sliding off the side of the ramps as the fabrics move up the ramps so the ramps are more fully effective in causing the aforementioned toroidal movement or turnover. Secondly, as fabrics ride up each ramp the movement of those fabrics which engage the upwardly extending wall 102 is slowed, relative to adjacent fabrics radially inward of the ramp. This further enhances the relative displacement of the fabrics, which aids turnover and redistribution. Moreover, as fabrics ride up the top of the wall 102, the wall projects into the fabrics and tends to physically separate the fabrics. Because the height of the wall 102 above the surface 104 of the ramp progressively increases from the bottom to the top of the ramp, the wall has a progressively increasing effect on the fabrics engaging the wall. The above actions effected by the upwardly extending wall 102 of the ramp improve the washing of the fabrics and reduce the tendency of fabrics to tangle.

It can be seen from the above description that the washing action in the washing machine shown and described provides a multiple motion of the fabrics which comprise the fabric load in the basket 26. The impacting of the fabric load by the side wall 31, including ribs 84 and 86, during inward movement as the basket orbits and the impacting of the fabric load by the vertical sections 92 of the annular ledges 90 during outward movement cause an annular movement of the fabrics along generally horizontal regions in a direction opposite to the orbiting movement of the basket. The downwardly and outwardly sloping arrangement of the annular ledges causes a radially outward movement of the fabrics at the bottom of the basket. This helps the fabrics to circulate in a toroidal manner in vertically extending regions so that different ones of the fabrics are progressively brought into engagement with the surface of the basket where the washing action is the greatest. The third movement of the fabrics is effected by the ramps 100 which help toroidal turnover of the fabrics in generally vertically extending regions. The ramps also cause redistribution of the fabrics in the load so that fabrics are continually moving between the interior and exterior areas of the mass or load of fabrics and all the fabrics are engaged by the surface of the basket for most effective washing action. These multiple actions cause thorough circulation and mixing of the fabrics so that each fabric comprising the fabric load is subjected to approximately equal washing action. The addition of the vertical wall 102 to the ramps, in accordance with the present invention, further improves the washing action by enhancing the action of the ramp in providing turnover and redistribution of the fabrics.

While a particular form of this invention has been shown and described, it will be apparent that modifications of the structure shown and described may be made by those skilled in the art without departing from the invention. For example, the vertical wall 102 may be made of a different height than that shown, the width of the ramp at the upper end may be increased or decreased, the slope provided by the section 108 may be altered or eliminated, and the inclination of the ramps may be varied, depending on the particular washing action desired. It is intended therefore, by the appended claims to cover all modifications which come within the spirit and scope of this invention.

I claim:

1. In a washing machine for fabric articles comprising a receptacle having a central axis and arranged to receive a washing liquid and a fabric article load to be washed by the liquid, said receptacle including a bottom wall and a side wall, drive means operatively connected to said receptacle, said drive means being constructed and arranged to move said receptacle so that said central axis moves in an orbital path, the improvement comprising:

(a) a plurality of circumferentially spaced ramps extending inwardly from said side wall;

(b) each of said ramps having a surface inclined upwardly in a direction opposite to the direction of orbiting movement of said receptacle; and (c) a wall at the inner edge of each of said ramps, said wall extending above said surface.

2. The washing machine of claim 1 wherein said ramp wall extends downwardly to the bottom of said receptacle.

3. The washing machine of claim 2 wherein the height of said ramp wall above said surface is greatest at the upper portion of said ramp.

4. The washing machine of claim 3 wherein the height of said ramp wall above said surface is progressively reduced from the upper portion to the lower portion of said ramp.

5. The washing machine of claim 2 wherein the portion of said wall extending above said surface is of inverted V cross section and includes a vertical section at the inner edge of said ramp and an inclined section joining the top of said vertical section to said surface.

6. The washing machine of claim 2 wherein said surface of each ramp progressively decreases in width from a maximum at the bottom of said ramp to a minimum at the top thereof.

7. The washing machine of claim 2 wherein said basket includes a downwardly and outwardly inclined bottom wall for directing fabrics toward said ramps, said ramp wall causing turnover and redistribution of the fabrics.

8. The washing machine of claim 7 wherein said downwardly and outwardly inclined bottom wall comprises a plurality of annular ledges and the lower end of each ramp extends over at least some of said ledges.

9. The washing machine of claim 8 wherein said ramp wall of each of said ramps extends over at least some of said annular ledges at the lower end of said ramp and said ramp wall is disposed radially outward of the radially outermost of said annular ledges at the upper end of said ramp.

* * * * *